US006279844B1

(12) United States Patent
Shen et al.

(10) Patent No.: US 6,279,844 B1
(45) Date of Patent: Aug. 28, 2001

(54) FUEL INJECTOR HAVING FAULT TOLERANT CONNECTION

(75) Inventors: Jingming J. Shen; Gyula A. Huszar, both of Newport News, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/271,532

(22) Filed: Mar. 18, 1999

(51) Int. Cl.[7] ..... F02M 51/00
(52) U.S. Cl. ..... 239/585.4; 239/585.1
(58) Field of Search ..... 239/585.4, 585.5, 239/585.3, 585.1, 596, 463; 219/121.63, 121.64

(56) References Cited

U.S. PATENT DOCUMENTS 4,643,359 2/1987 Casey .
5,002,231 * 3/1991 Reiter et al. ..... 239/585.1
5,192,048 * 3/1993 Wakeman ..... 239/585.3 X
5,494,224 2/1996 Hall et al. .
5,580,001 * 12/1996 Romann et al. ..... 239/585.4
5,625,946 5/1997 Wildeson et al. .
5,630,400 5/1997 Sumida et al. .
5,636,827 * 6/1997 Kilgore et al. ..... 239/585.5 X
5,871,157 2/1999 Fukutomi et al. .
5,875,972 * 3/1999 Ren et al. ..... 239/463
6,027,049 * 2/2000 Steir ..... 239/585.1
6,027,050 * 2/2000 Rembold et al. ..... 239/585.1 X

* cited by examiner

*Primary Examiner*—Lesley D. Morris

(57) ABSTRACT

A fuel injector with a valve body having an inlet, an outlet, and an axially extending fuel passageway from the inlet to the outlet. An armature proximate the inlet of the valve body. A needle valve operatively connected to the armature. A valve seat proximate the outlet of said valve body. A fault tolerant structural connection between the valve seat and valve body that also provides a hermetic seal between the valve seat and valve body.

20 Claims, 3 Drawing Sheets

FUEL INJECTOR HAVING FAULT TOLERANT CONNECTION

FIELD OF INVENTION

This invention relates to fuel injectors in general and particularly high-pressure direct injection fuel injectors. More particularly to high-pressure direct injection fuel injectors having a valve seat joined to a valve body.

BACKGROUND OF THE INVENTION

It is known in the art relating to fuel injectors to have a separate valve seat positioned proximate a valve body. In this type of injector arrangement, the valve seat and the valve body are arranged so that that the valve seat is located in a proper operative position in the fuel injector. The connection between the valve seat and valve body should fixedly secure the two components together, as well as, provide a hermetic seal that prevents fuel leaks.

It is believed that the connection between the valve seat and the valve body can be accomplished by different techniques. One known technique is a weld connection. In this arrangement, the valve seat is welded to an end of the valve body in such a fashion that the weld secures the valve seat within an end of the valve body and forms a hermetic seal between the valve seat and the valve body. Another known technique is the crimp/elastomer connection. In this arrangement, the end of the valve body is crimped around the valve seat to secure the valve seat within an end of the valve body. To ensure that a hermetic seal is achieved when the crimp arrangement is employed, an elastomeric member, such as an O-ring, is installed between the valve seat and the valve body.

In a direct injection application, the injector is required to operate in an environment of higher pressures and temperatures than a non-direct injection installation, such as, manifold injector installations. It is believed that the known connection techniques may not endure direct injection operative conditions over prolonged periods of time. The weld connection between the valve seat and the valve body does not provide a failsafe valve seat and valve body connection in the event of weld failure during prolonged operation. Catastrophic failure of the engine could result when the weld connection fails and valve seat enters the engine cylinder. It is also believed that the elastomer in the crimp/elastomer connection between the valve seat and the valve body will deteriorate during prolonged use in a direct injection application.

SUMMARY OF THE INVENTION

The present invention provides a fuel injector with a valve body having an inlet, an outlet, and an axially extending fuel passageway from the inlet to the outlet. An armature is located proximate the inlet of the valve body. A needle valve is operatively connected to the armature. A valve seat is located proximate the outlet of the valve body. A fault tolerant structural connection is provided between the valve seat and the valve body that also provides a hermetic seal between the valve seat and the valve body.

The fault tolerant structural connection is a mechanical connection between the valve seat and the valve body that ensures retention of the valve seat to the valve body and provides a hermetic seal between the valve seat and valve body. In a preferred embodiment of the invention, the fault tolerant structural connection comprises a crimped end section of the valve body that engages the valve seat and a weld joint between the valve body and valve seat. The weld joint, preferably, is a laser weld joint.

It is to be understood that the fault tolerant structural connection may comprise various arrangements. For example, the fault tolerant structural connection maybe a self-locking threads on the valve seat and the valve body and a weld joint between the valve body and the valve seat. Rather than self-locking threads, a slot and groove configuration on the valve seat and the valve body could be employed. Alternatively, the fault tolerant structural connection could comprise a self-locking threaded connection between the valve seat and valve body that forms a hermetic seal and a crimped end section of the valve body that engages the valve seat. In any event, each of the fault tolerant structural connections must be a mechanical connection between the valve seat and valve body that ensures retention of the valve seat to the valve body and provides a hermetic seal between the valve seat and the valve body.

The fuel injector of the present invention may also include a swirl generator that allows the fuel to form a swirl pattern on the valve seat in the fuel injector. The swirl generator, preferably, includes two flat disks. One disk is a guide disk having a perimeter, a central aperture, and at least one fuel passage opening between the perimeter and the central aperture. The other disk is a swirl disk having at least one slot extending tangentially from the opening to the central aperture of the guide disk. The valve seat includes a fuel passageway having a conical annulus extending between an upstream side of the valve seat and a downstream side of the valve seat. The needle valve includes a curved surface that mates with the conical annulus to inhibit fuel flow through the fuel passageway of the valve seat. The curved surface on the needle valve, preferably, is spherical.

The present invention also includes a method of securing a valve seat to a valve body in a fuel injector. The valve seat is secured to the valve body of the fuel injector by locating a valve seat within the end of a valve body; crimping an end section of the valve body to the valve seat; and welding the crimped end section of the valve body to the valve seat.

The method of the present invention also includes providing both the valve seat and the valve body with chamfers so that when the end section of the valve body is crimped to the valve seat a gap is formed with a distance that allows for a hermetic weld joint to be formed between the valve seat and the crimped end section of the valve body.

BRIEF DESCRIPTION OF THE DRAWINGS

The accompanying drawings, which are incorporated herein and constitute part of this specification, illustrate presently preferred embodiments of the invention, and, together with a general description given above and the detailed description given below, serve to explain features of the invention.

DETAILED DESCRIPTION OF THE PREFERRED EMBODIMENTS(S)

Figure 1:
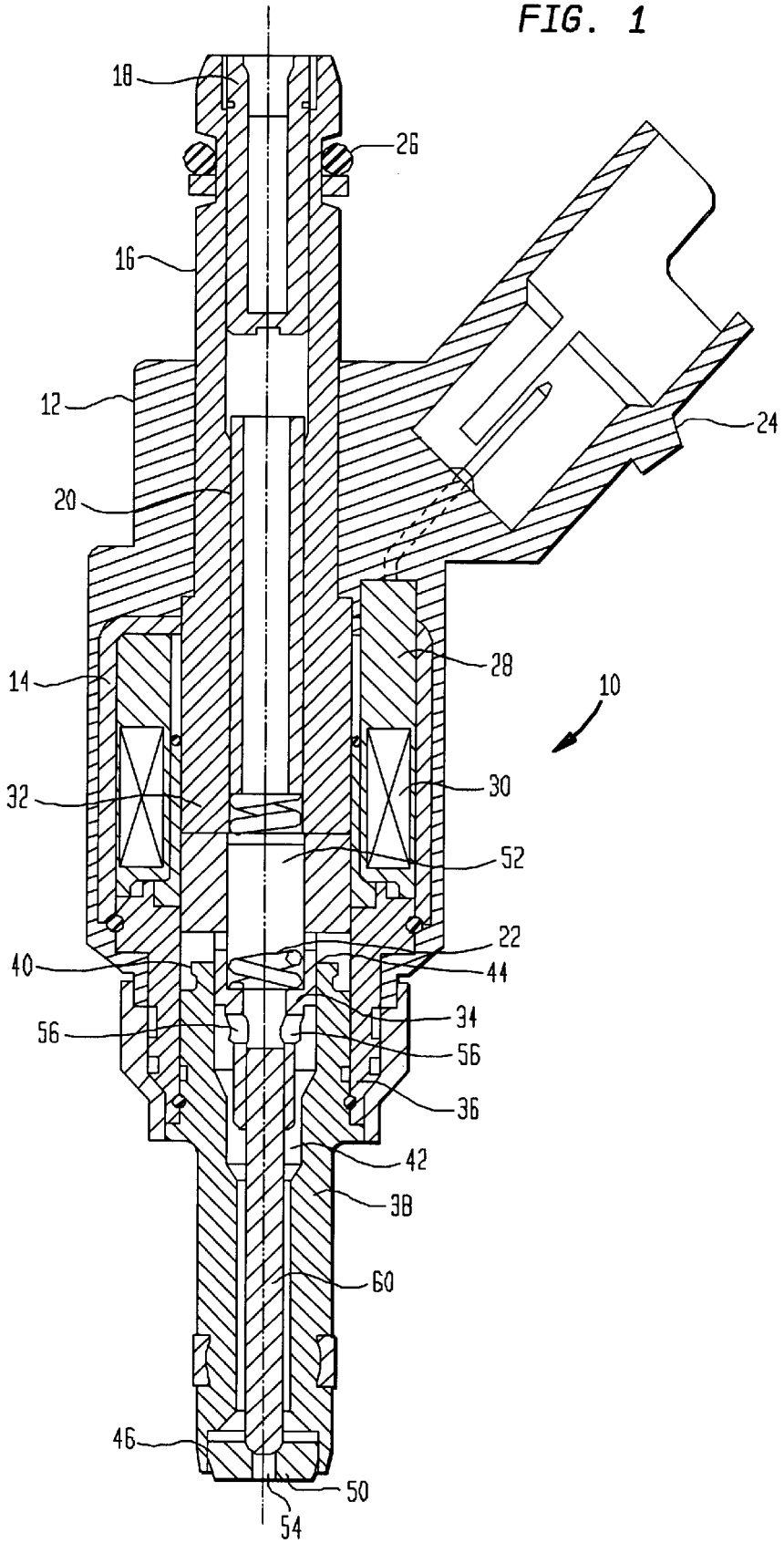
FIG. 1 is a cross-sectional view of a fuel injector taken along its longitudinal axis.

FIG. 1 illustrates a preferred embodiment of the high-pressure direct injection fuel injector of the present invention. The fuel injector 10 has an overmolded plastic member 12 encircling a metallic housing member 14. A fuel inlet 16 with an in-line fuel filter 18 and an adjustable fuel inlet tube 20 are disposed within the overmolded plastic member 12 and metallic housing member 14. The adjustable fuel inlet tube 20 is longitudinally adjustable to vary the length of an armature bias spring 22, which adjusts the fluid flow within the fuel injector 10. The overmolded plastic member 12 also supports a connector 24 that connects the fuel injector 10 to an external source of electrical potential, such as an electronic control unit (ECU, not shown). An O-ring 26 is provided on the fuel inlet 16 for sealingly connecting the fuel inlet 16 with a fuel supply member, such as a fuel rail (not shown).

The metallic housing member 14 encloses a bobbin 28 and a solenoid coil 30. The solenoid coil 30 is operatively connected to the connector 24. The portion of the inlet tube 32 proximate the bobbin 28 and solenoid coil 30 functions as a stator. An armature 34 is axially aligned with the inlet tube 16 by a valve body shell 36 and a valve body 38.

The valve body 38 is disposed within the valve body shell 36. An armature guide eyelet 40 is located at the inlet of the valve body. An axially extending fuel passageway 42 connects the inlet 44 of the valve body with the outlet 46 of the valve body 38. A valve seat 50 is located proximate the outlet 46 of the valve body. Fuel flows in fluid communication from the fuel inlet source (not shown) through the fuel inlet 16, the armature fuel passage 52, and valve body fuel passageway 42, and exits the valve seat fuel passageway 54.

The fuel passage 52 of the armature is axial aligned with the fuel passageway 42 of the valve body. Fuel exits the fuel passage 52 of the armature through a pair of transverse ports 56 and enters the inlet 44 of the valve body 38. The armature 34 is magnetically coupled to the portion of the inlet tube 32 that serves as a stator. The armature 34 is guided by the armature guide eyelet 40 and axially reciprocates along the longitudinal axis 58 of the valve body in response to an electromagnetic force generated by the solenoid coil 30. The electromagnetic force is generated by current flow from the ECU through the connector 24 to the ends of the solenoid coil 30 wound around the bobbin 28. A needle valve 60 is operatively connected to the armature 34 and operates to open and close the fuel passageway 54 in the valve seat, which allows and prohibits fuel from exiting the fuel injector 10.

The valve seat 50 is positioned proximate the outlet 46 of the valve body 38. The fuel injector 10 of the present invention includes a fault tolerant structural connection 62 between the valve seat 50 and the valve body 38 that also provides a hermetic seal between the valve seat 50 and the valve body 38.

Figure 2:
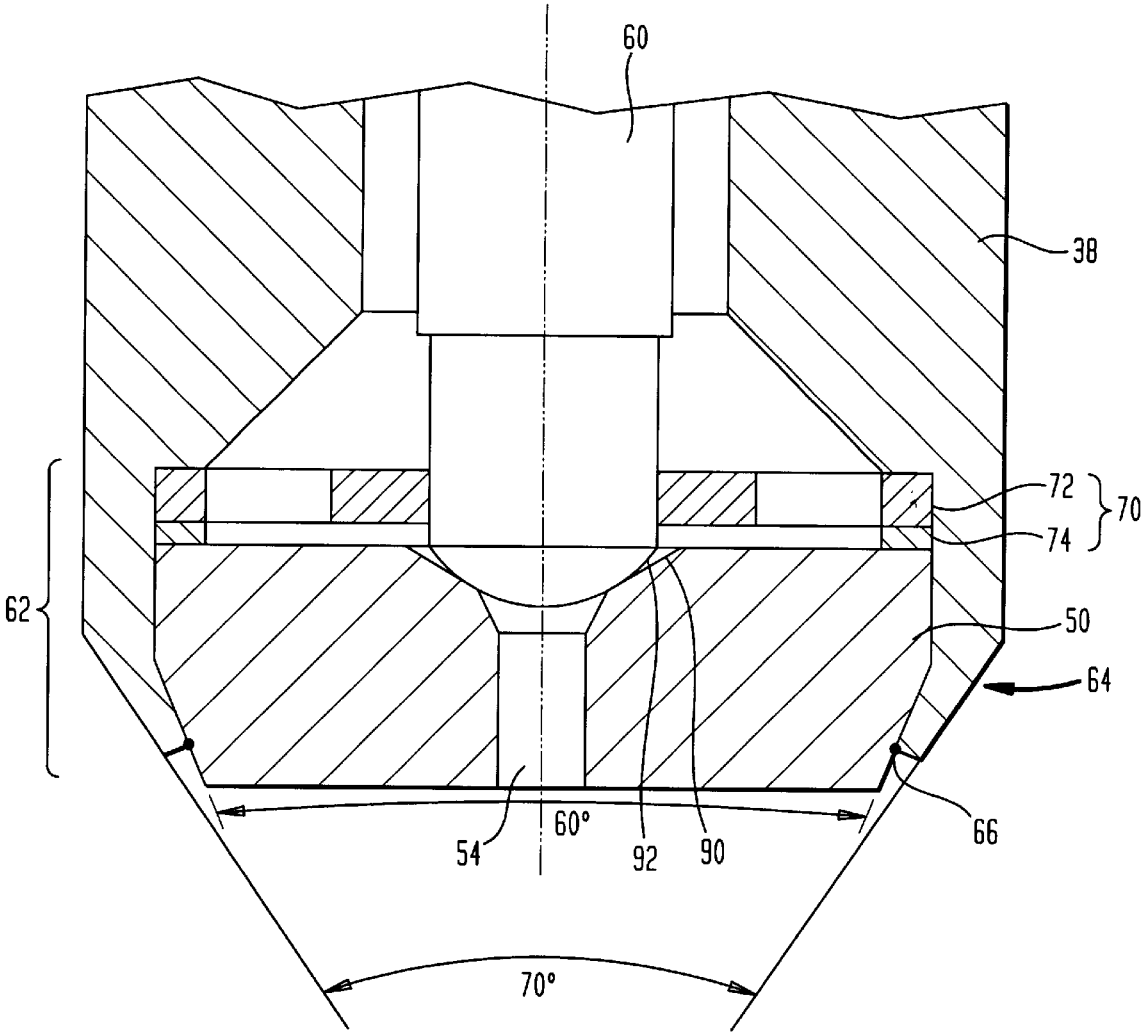
FIG. 2 is an enlarged cross sectional view of the valve seat portion of the fuel injector shown in FIG. 1.

FIG. 2 illustrates a preferred embodiment of the fault tolerant structural connection 62 invention of the present invention. The connection comprises a crimped end section 64 of the valve body 38 that engages the valve seat 50 and a weld joint 66 between the valve body 38 and the valve seat 50.

The valve seat 50 and the valve body 38 are provided with specified chamfers so that the crimped end section 64 and the valve seat 50 retain a physical relationship that allows for the weld joint 66 to be formed. More particularly, the chamfer angles are selected so that when the end section of the valve body is crimped, the crimped section engages the valve seat with minimal spring back. That is, the elastic properties of the metallic material that comprises the end section of the valve body are minimized. Preferably, the metallic material of the crimped end section of the valve body plastically deforms to engage the valve seat.

Figure 3:
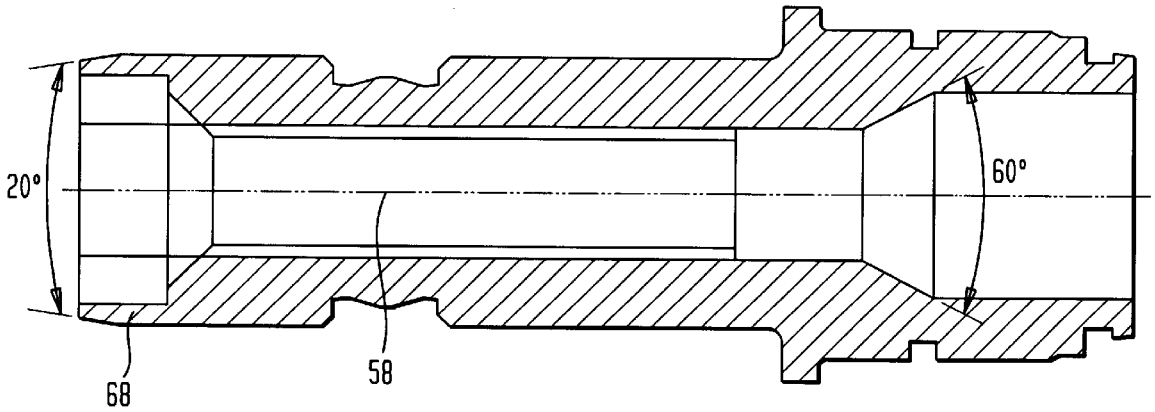
FIG. 3 is a cross-sectional side view of the fuel injector valve body prior to installation in the fuel injector illustrated in FIG. 1.

As illustrated in FIG. 2, the preferred valve seat 50 has a chamfer of approximately 60° included angle, while the crimped end section 64 of the valve body 38 has approximately a 70° included angle. As illustrated in FIG. 3, the preferred pre-crimped end section 68 of the valve body has a chamfer of approximately 20° included angle.

The weld joint 66, preferably, comprises a laser weld joint. The laser weld joint comprises a portion of the valve body and a portion of the valve seat. The portion of the valve body 38 is greater than the portion of the valve seat 50. The portion of the valve body 38 comprises approximately ⅔ of the laser weld joint and the portion of the valve seat 50 comprises approximately ⅓ of the laser weld joint. The valve body 38, preferably, comprises 416P70 stainless steel. The valve seat 50, preferably, comprises 440C carbon steel.

In the preferred embodiment of the invention, a swirl generator 70 is located upstream of the valve seat 50 in the fuel passageway 42 of the valve body 38, and allows fuel to form a swirl pattern on the valve seat 50. The swirl generator 70, preferably, is constructed from at least one flat disk; however, various configurations of a swirl generator could be employed. The swirl generator 70, as illustrated in FIG. 2, includes a pair of flat disks, a guide disk 72 and a swirl disk 74.

Figure 4A:
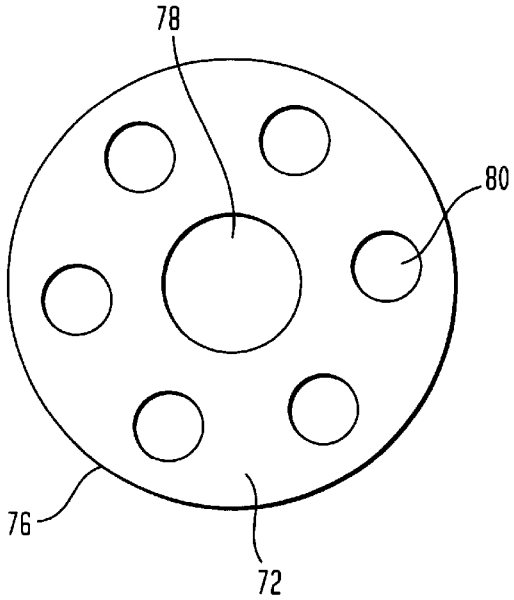
FIGS. 4A and 4B are plan views of components of the fuel injector's swirl generator illustrated in FIGS. 1 and 2.
Figure 4B:
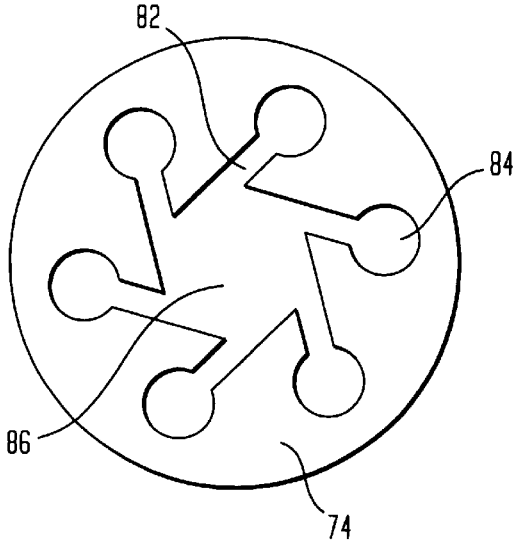

The guide disk 72, illustrated in FIG. 4A, has a perimeter 76, a central aperture 78, and a plurality of fuel passage openings 80 between the perimeter 76 and the central aperture 78. Alternatively, a single fuel passage opening could be employed. The swirl disk 74, illustrated in FIG. 4B, has a plurality of slots 82 that corresponds to the plurality of fuel passage openings 80 in the guide disk 72. Each of the slots 82 extends tangentially from the respective fuel passage opening 84 toward a central aperture region 86, and provides a tangential fuel flow path for fuel flowing through the swirl disk 74 to a valve needle 60.

The needle valve 60 is guided in the central aperture 78 of the guide disk 72. The plurality of fuel passage openings 80 supply fuel from the fuel passageway 42 to the swirl disk 74. The swirl disk 74 directs fuel from the fuel passage openings 80 in the guide disk 72 and meters the fuel flow to the valve seat 60. The guide and swirl disks 72, 74 that form the swirl generator 70 are connected, preferably, by a weld connection to the valve seat 50.

The fuel passageway 54 of the valve seat 50 has a conical annulus 90 extending between an upstream side of the valve seat 50 and a downstream side of the valve seat 50. The needle valve has a curved surface 92, which in the preferred embodiment is a spherical surface although other surfaces may be used, for mating with a circular band on the conical annulus 90. A further detailed description of the interaction of the curved surface of the needle valve and the conical annulus of the valve seat, in addition to the specifics of the fluid flow develop because of the interaction between these components and the swirl generator, is provided in commonly assigned U.S. Pat. No. 5,875,972, which is expressly incorporated herein in its entirety by reference.

The present invention also includes a method of securing the valve seat 50 to a valve body 38. The valve seat 50 is initially located within the end of the valve body, which in the preferred embodiment constitutes the outlet 46 of the valve body 38. After the valve seat 50 is located in the outlet 46 of the valve body 50, an end section 68 of the valve body 38 is crimped to the valve seat 50. The valve seat 50 and the valve body 38 are provided with specified chamfers so that when the end section 68 of the valve body 38 is crimped to the valve seat 50 a minimum gap is formed. The valve seat 50 is, preferably, provided with a chamfer of approximately 60° included angle. It is to be understood that a range of angles may be employed for the chamfer of the valve seat, for example, approximately 40°–60° included angle. The pre-crimped end section 68 of the valve body is, preferably, provided with a chamfer of 20° included. The end section 64 of the valve body is, preferably, crimped to the valve seat with approximately a 70° included angle.

After crimping the end section 64 of the valve body 38 to the valve seat 50, a laser weld strategy is employed to form the hermetic weld joint 66 between the crimped end section 64 of the valve body 38 and the valve seat 50. A laser weld joint 66 is formed from approximately ⅔ from a portion of the valve body and approximately ⅓ from a portion of the valve seat.

While the invention has been disclosed with reference to certain preferred embodiments, numerous modifications, alterations and changes to the described embodiments are possible without departing from the sphere and scope of the invention, as defined in the appended claims and equivalents thereof. Accordingly, it is intended that the invention not be limited to the described embodiments, but that it have the full scope defined by the language of the following claims.

What is claimed is:

1. A fuel injector comprising:

a valve body having an inlet, an outlet, and an axially extending fuel passageway from the inlet to the outlet;

an armature proximate the inlet of the valve body;

a needle valve operatively connected to the armature;

a valve seat proximate the outlet of said valve body; and a fault tolerant structural connection that includes first and second connections between the valve seat and the valve body, the first connection including a crimped end section of the valve body, and the second connection including a hermetic weld.

2. The fuel injector of claim 1, wherein the crimped end section of the valve body engages the valve seat and the weld comprises a joint between the valve body and valve seat.

3. A fuel injector comprising:

a valve body having an inlet, an outlet, and an axially extending fuel passageway from the inlet to the outlet;

an armature proximate the inlet of the valve body;

a needle valve operatively connected to the armature;

a valve seat proximate the outlet of said valve body, the valve seat comprises a chamfer a approximately 60° included angle; and a fault tolerant structural connection between the valve seat and valve body, the fault tolerant structural connection including a crimped end section of the valve body that engages the valve seat and a hermetic seal between the valve body and valve seat, the crimped end section of the valve body comprises a chamfer of approximately 70° included angle.

4. The fuel injector of claim 3, wherein the pre-crimped end section of the valve body comprises a chamfer of approximately 20° included angle.

5. The fuel injector of claim 2, wherein the weld joint comprises a laser weld joint.

6. The fuel injector of claim 5, wherein the laser weld joint comprises a portion of the valve body and a portion of the valve seat.

7. The fuel injector of claim 6, wherein the portion of the valve body is greater than the portion of the valve seat.

8. The fuel injector of claim 7, wherein the portion of the valve body comprises approximately ⅔ of the laser weld joint and the portion of the valve seat comprises approximately ⅓ of the laser weld joint.

9. The fuel injector of claim 8, wherein the valve body comprises 416P70 stainless steel.

10. The fuel injector of claim 8, wherein the valve seat comprises 440C carbon steel.

11. The fuel injector of claim 1, further comprising a swirl generator proximate the valve seat that allows the fuel to form a swirl pattern on the valve seat.

12. The fuel injector of claim 11, wherein the swirl generator comprises at least one flat disk;

wherein the valve seat includes a fuel passageway having a conical annulus extending between an upstream side of the valve seat and a downstream side of the valve seat; and wherein the needle valve includes a curved surface that mates with the conical annulus to inhibit fuel flow through fuel passage of the valve seat.

13. The fuel injector according to claim 12, wherein the at least one flat disk comprises at least:

(1) a guide disk having a perimeter, a central aperture, and at least one fuel passage opening between the perimeter and the central aperture; and (2) a swirl disk having at least one slot extending tangentially from the opening to the central aperture.

14. The fuel injector according to claim 12, wherein said curved surface on said needle valve is spherical.

15. A method of securing a valve seat to a valve body in a fuel injector comprising:

locating a valve seat within the end of a valve body;

crimping an end section of the valve body to the valve seat; and welding the crimped end section of the valve body to the valve seat.

16. The method of claim 15, further comprising:

providing both the valve seat and valve body with chamfers so that when the end section of the valve seat is crimped to the valve seat a gap is formed with a distance that allows for a hermetic weld joint to be formed between the valve seat and the crimped end section of the valve body.

17. A method of securing a valve seat to a valve body in a fuel injector, the method comprising:

providing a valve seat with a chamfer of 60° included angle;

providing an end section of a valve body with a chamfer of 20° includes;

locating the valve seat within the end section of the valve body;

crimping the end section of the valve body to the valve seat with a 70° included angle; and welding the crimped end section of the valve body to the valve seat.

18. The method of claim 17, further comprising:

employing a laser weld to form the hermetic weld joint between the crimped end section of the valve body and the valve seat.

19. The method of claim 18, further comprising:

forming the hermetic weld joint with a portion of the valve body and a portion of the valve seat.

20. The method of claim 19, further comprising:

forming approximately ⅔ of the hermetic weld joint from the portion of the valve body and approximately ⅓ of the hermetic weld joint from the portion of the valve seat.

* * * * *